US008376001B1

(12) United States Patent
Wallauer

(10) Patent No.: US 8,376,001 B1
(45) Date of Patent: Feb. 19, 2013

(54) FUEL LEVER ACTUATION RETENTION APPARATUS

(76) Inventor: Robert R. Wallauer, Cape Coral, FL (US)

( * ) Notice: Subject to any disclaimer, the term of this patent is extended or adjusted under 35 U.S.C. 154(b) by 622 days.

(21) Appl. No.: 12/630,910

(22) Filed: Dec. 4, 2009

(51) Int. Cl.
*B65B 1/30* (2006.01)

(52) U.S. Cl. ..... 141/218; 141/206; 141/392

(58) Field of Classification Search ..... 141/392, 141/218, 206; 251/90, 107
See application file for complete search history.

(56) References Cited

U.S. PATENT DOCUMENTS

| | | | | |
|---|---|---|---|---|
| 4,095,629 | A | | 6/1978 | Jordan |
| 4,201,253 | A | | 5/1980 | Maloney |
| 5,118,074 | A | | 6/1992 | Weissman |
| D332,046 | S | * | 12/1992 | Isett ..... D8/349 |
| 5,240,226 | A | | 8/1993 | Bobst |
| D362,612 | S | | 9/1995 | Will |
| 6,418,988 | B1 | | 7/2002 | Palumbo et al. |
| 2006/0185765 | A1 | | 8/2006 | Bates, III |

* cited by examiner

*Primary Examiner* — Gregory Huson
*Assistant Examiner* — Jason K Niesz

(57) ABSTRACT

A fuel lever actuation retention apparatus for retaining the fuel actuation lever of a fuel nozzle in an engaged position includes includes a rectangular bracket that is abuttable against the fuel actuation lever and the guard to support the fuel actuation lever in an engaged position. The bracket has a front wall and a rear wall, a first end and a second end disposed opposite of each other, and a pair of lateral sides. The first end is contactable with the fuel actuation lever and the second end is contactable with the guard to retain the fuel actuation lever in a spaced relationship with the guard. A plurality of retaining members are attached to, and extend outwardly from, the bracket. The retaining members are configured to prevent lateral removal of the bracket when the bracket is disposed between the fuel actuation lever and the guard. The bracket has four corners, each of the corners having a retaining member attached thereto.

12 Claims, 4 Drawing Sheets

FUEL LEVER ACTUATION RETENTION APPARATUS

BACKGROUND OF THE DISCLOSURE

Field of the Disclosure

The disclosure relates to retention apparatus and more particularly pertains to a new retention apparatus for retaining the fuel actuation lever of a fuel nozzle in an engaged position.

SUMMARY OF THE DISCLOSURE

An embodiment of the disclosure meets the needs presented above by generally comprising a fuel lever actuation retention apparatus for use with a fuel nozzle having a nozzle handle, a fuel actuation lever, and a guard extending around the lever. The apparatus includes a rectangular bracket that is abuttable against the fuel actuation lever and the guard to support the fuel actuation lever in an engaged position. The bracket has a front wall and a rear wall, a first end and a second end disposed opposite of each other, and a pair of lateral sides. The first end is contactable with the fuel actuation lever and the second end is contactable with the guard to retain the fuel actuation lever in a spaced relationship with the guard.

A plurality of retaining members is attached to, and extend outwardly from, the bracket. The retaining members are configured to prevent lateral removal of the bracket when the bracket is disposed between the fuel actuation lever and the guard. The bracket has four corners, each of the corners having a retaining member attached thereto.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
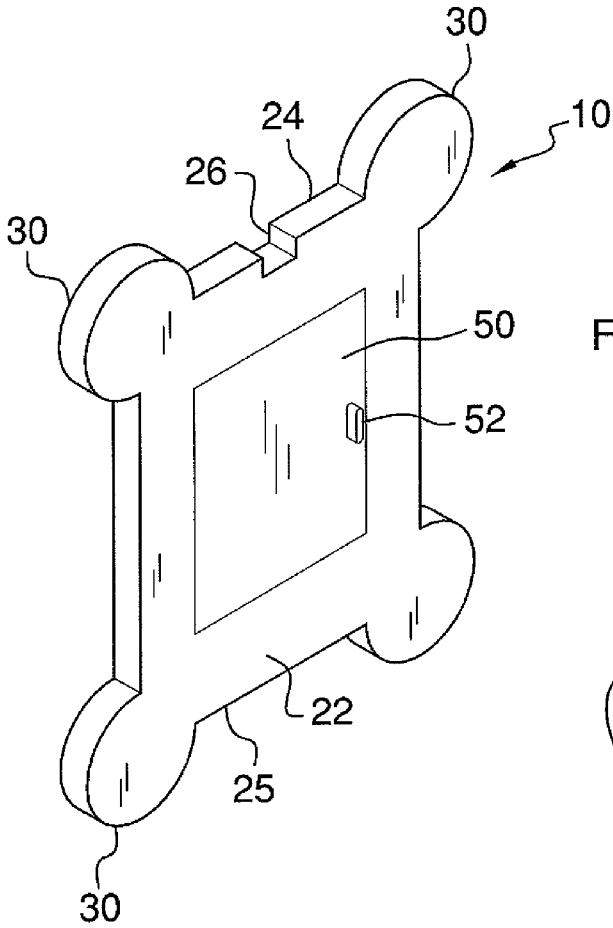
FIG. 1 is a schematic front isometric view of a fuel lever actuation retention apparatus according to an embodiment of the disclosure.
Figure 2:
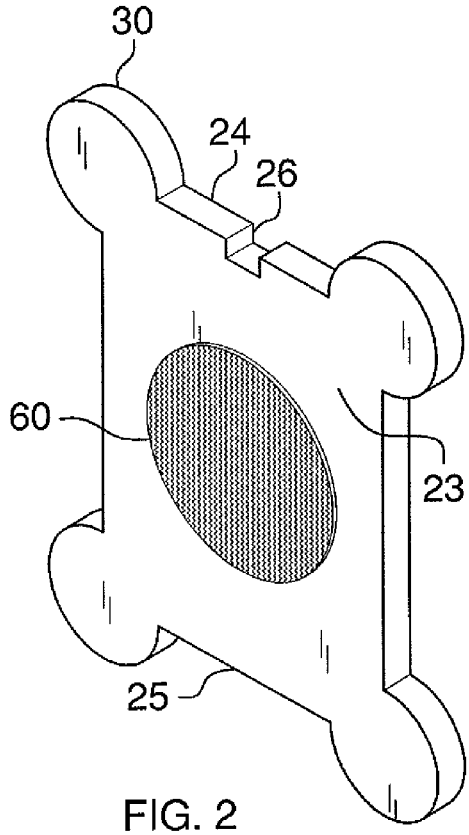
FIG. 2 is a schematic rear isometric view of an embodiment of the disclosure.
Figure 3:
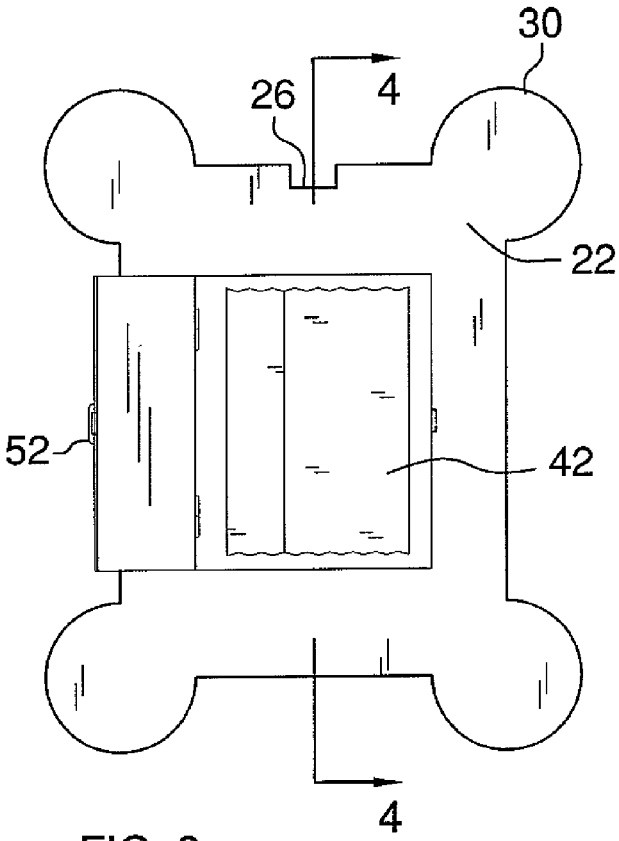
FIG. 3 is a schematic front view of an embodiment of the disclosure.
Figure 4:
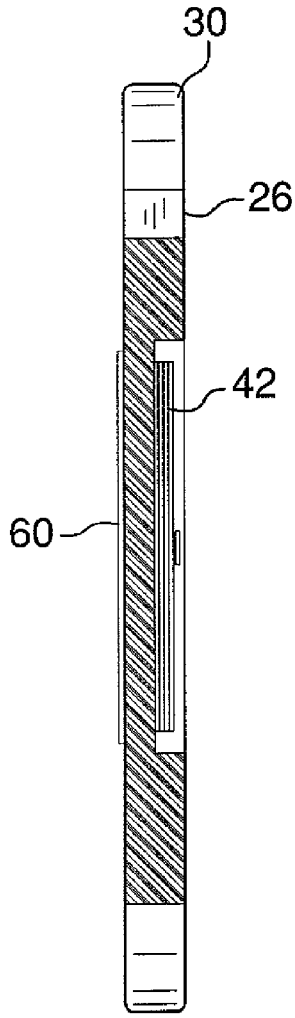
FIG. 4 is a schematic cross-sectional view along the line 4-4 of an embodiment of the disclosure shown in FIG. 3.

With reference now to the drawings, and in particular to FIGS. 1 through 6 thereof, a new retention apparatus for retaining the fuel actuation lever of a fuel nozzle in an engaged position embodying the principles and concepts of an embodiment of the disclosure and generally designated by the reference numeral 10 will be described.

Figure 5:
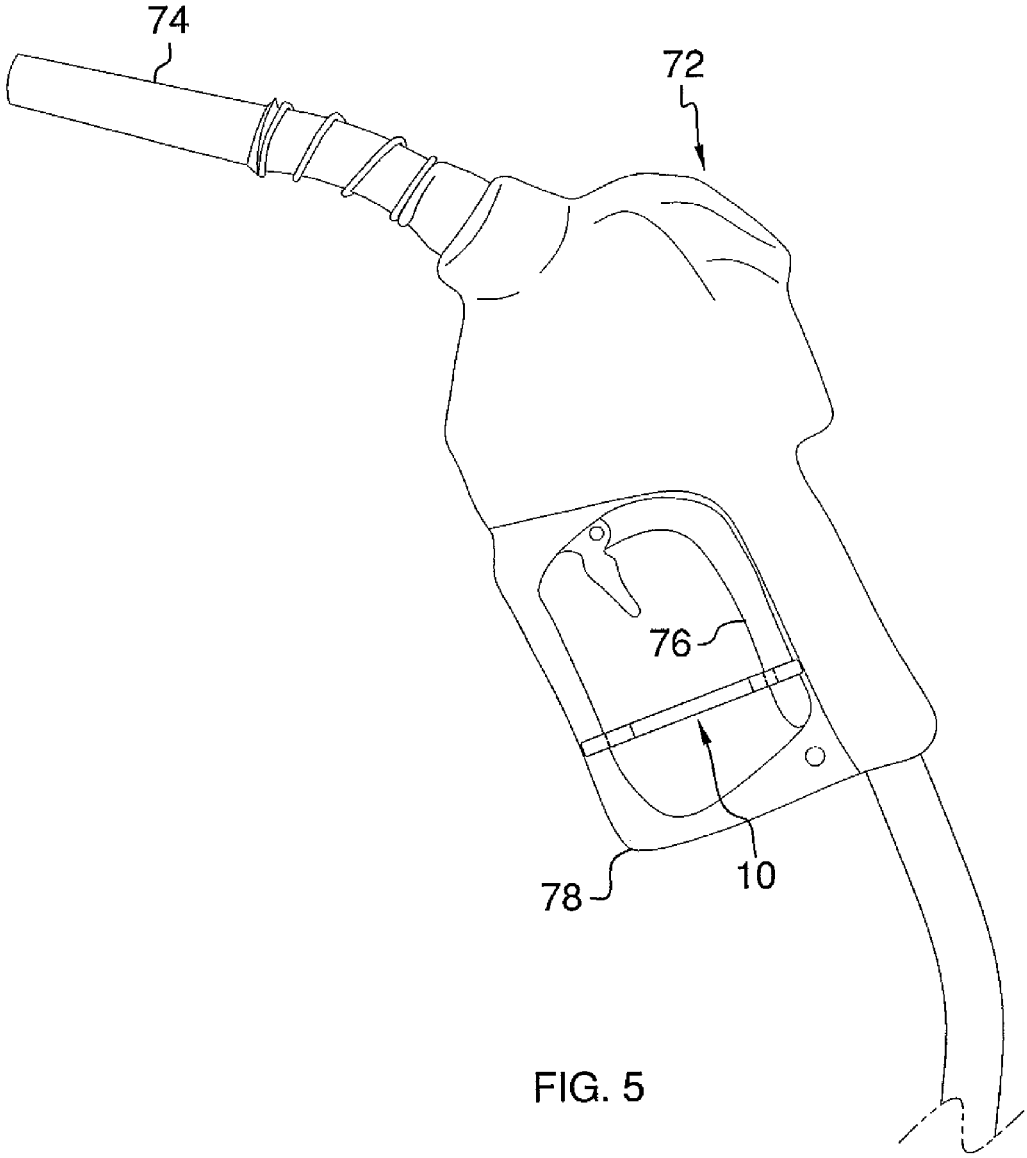
FIG. 5 is a schematic perspective view of an embodiment of the disclosure installed in a fuel nozzle.

As best illustrated in FIGS. 1 through 6, the fuel lever actuation retention apparatus 10 for use with a fuel nozzle 74 having a nozzle handle 72, a fuel actuation lever 76, and a guard 78 extending around the lever generally comprises a bracket 20 that is abuttable against the fuel actuation lever 6 and the guard to support the fuel actuation lever 6 in an engaged position, according to an embodiment, as shown in FIG. 5. The bracket may be rectangular shaped and has a front wall 22 and a rear wall 23, and a first end 24 and a second end 25 positioned opposite of each other. The bracket 20 may have a pair of lateral sides extending between the first end 24 and the second end 25, so that the bracket 20 has four corners. A width of the bracket 20 may range from approximately one inch to approximately three inches and a height of the bracket 20 may range from approximately 2 inches to approximately 4 inches. A depth of the bracket 20 may range from approximately 0.125 inches to approximately 1 inch.

The first end 24 of the bracket 20 may be contactable with the fuel actuation lever 6 of the fuel nozzle 2, while the second end 25 may be contactable with the guard to retain the fuel actuation lever 6 in a spaced relationship with said guard. With the bracket 20 installed between the fuel actuation lever 6 and the guard, the fuel actuation lever 6 is held in an engaged position, and fuel is enabled for flowing from the nozzle. In an embodiment, the bracket 20 may be reversed such that the second end 25 of the bracket 20 may be contactable with the fuel actuation lever 6 and the first end 24 contactable with the guard. In a further embodiment, the bracket 20 may be rotated one-quarter turn so that one of the pair of lateral sides contacts the fuel actuation lever 6 and another of the pair of lateral sides contacts the nozzle handle 4, holding the fuel engagement lever in an engaged position.

According to an embodiment, the first end 24 of the bracket 20 may have a notch 26 for receiving a portion of the fuel actuation lever 6. The notch 26 is configured to minimize lateral movement of the bracket 20 relative to the nozzle handle 4 to hold the bracket 20 in place, such as when the bracket 20 is first installed on a fuel nozzle 2 or such as when an operator may accidentally bump into the bracket 20. The notch 26 may have a width ranging from approximately 0.125 inches to 0.375 inches, while the height may range from 0.125 inches to 0.375 inches.

A plurality of retaining members 30 may be attached to the corners of the bracket 20, according to an embodiment. The retaining members 30 may extend outwardly from the bracket 20 so as to prevent lateral removal of the bracket 20 when it is installed between the fuel actuation lever 6 and the guard. The retaining members 30 may have an annular perimeter edge and may lie in a plane that is oriented parallel to the plane of the bracket 20. The retaining members 30 may comprise any protrusion from the corners of the bracket 20 such that the protrusion is capable of preventing lateral removal of the bracket 20 when it is installed on the fuel nozzle 2.

A compartment 40 may be disposed between the front wall 22 and the rear wall 23 for containing a plurality of wipes 42. The wipes 42 may be constructed of a soft, absorbent material moistened with a solvent capable of cleaning fuel from the hands of an operator. The wipes 42 may be replaceable when the user has exhausted the supply of wipes 42 in the compartment. The front wall 22 may have an aperture 44 for granting an operator access to the interior of the compartment 40.

A door 50 may be attached to the bracket 20, according to an embodiment. The door 50 may be selectively positioned in a closed position to close the aperture 44 or in an open position to permit access to the compartment 40. In the closed position, the door may substantially seal the compartment so that moisture within the compartment is retained by the compartment. In this way, wipes 42 wetted with a solvent or other liquid will maintain their moist condition. The door 50 may be coupled to the bracket 20 on one edge with a hinge, and may have a handle 52 attached about the opposite edge.

Figure 6:
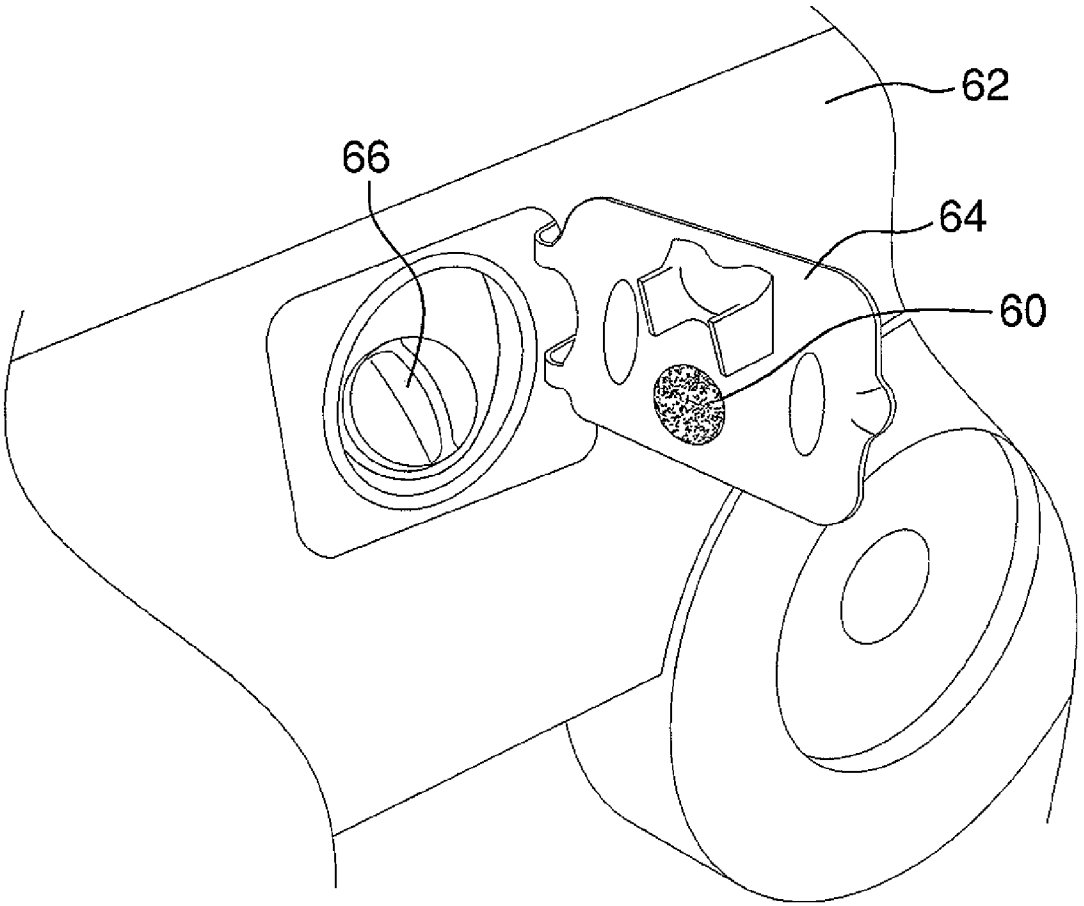
FIG. 6 is a schematic perspective view of a mating member of an embodiment of the disclosure installed on a fuel door.

A fastener 60 may be attached to the rear wall 23 of the bracket 20 for securing the bracket 20 to a vehicle 62 and more particularly to a fuel door 64 of the vehicle 62. As shown in FIG. 6, the fastener 60 may include a first mating member and a second mating member, where the first mating member is attached to the bracket 20 and the second mating member is attached to the vehicle 62. According to an exemplary embodiment, the fastener 60 may comprise a hook and loop fastener 60.

In use, the apparatus 10 may be used by first extending a fuel nozzle 74 into a fuel port 66 of the vehicle 62. The rectangular bracket 20 may be placed in abutment with the fuel actuation lever 76 and the guard 78 to support the fuel actuation lever 76 in an engaged position, thereby engaging the flow of fuel from the fuel nozzle 74 to the vehicle 62. The notch 26 may receive a portion of the fuel actuation lever 76 to minimize lateral movement of the bracket 20 relative to the nozzle handle 72. The door 50 of the compartment 40 may be opened to expose a plurality of wipes 42, one of which may be removed for use by the operator in cleaning his hands of fuel. The door 50 may then be closed to secure the plurality of wipes 42 in the compartment 40. When the vehicle 12 is filled with fuel, the bracket 20 may be fastened to the vehicle with the fastener 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A fuel lever actuation retention apparatus for use with a fuel nozzle having a nozzle handle, a fuel actuation lever, and a guard extending around the lever, said apparatus comprising:

a rectangular bracket being abuttable against the fuel actuation lever and the guard to support the fuel actuation lever in an engaged position, said bracket having a front wall and a rear wall, said bracket having a first end and a second end disposed opposite of each other and a pair of lateral sides, said first end being contactable with the fuel actuation lever and said second end being contactable with the guard to retain the fuel actuation lever in a spaced relationship with said guard;

a plurality of retaining members being attached to said bracket and extending outwardly therefrom, said retaining members being configured to prevent lateral removal of said bracket when bracket is disposed between the fuel actuation lever and the guard, said bracket having four corners, each of said corners having one of said retaining members attached thereto;

a compartment being disposed between said front wall and said rear wall, a plurality of wipes being positionable within said compartment, said front wall having an aperture therein to access an interior of said compartment;

a door being attached to said bracket and being selectively positioned in a closed position to close said aperture, said door being positioned in an open position to access said compartment.

2. The apparatus according to claim 1, wherein said first end has a notch therein configured to receive a portion of the fuel actuation lever to minimize lateral movement of the bracket relative to the nozzle handle.

3. The apparatus according to claim 1, wherein each of said retaining members has a perimeter edge having an annular shape, each of said retaining members lying in a plane orientated parallel with a plane of said bracket.

4. The apparatus according to claim 1, wherein said door is hingedly coupled to said bracket.

5. The apparatus according to claim 1, further including a handle being attached to said door.

6. The apparatus according to claim 1, further including a fastener being attached to said bracket, said bracket being securable to a vehicle with said fastener.

7. The apparatus according to claim 6, wherein said fastener includes a first mating member and a second mating member, said first mating member being attached to said bracket, said second mating member being attachable to the vehicle.

8. A fuel lever actuation retention apparatus for use with a fuel nozzle having a nozzle handle, a fuel actuation lever, and a guard extending around the lever, said apparatus comprising:

a rectangular bracket being abuttable against the fuel actuation lever and the guard to support the fuel actuation lever in an engaged position, said bracket having a front wall and a rear wall, said bracket having a first end and a second end disposed opposite of each other and a pair of lateral sides, said first end being contactable with the fuel actuation lever and said second end being contactable with the guard to retain the fuel actuation lever in a spaced relationship with said guard, said first end having a notch therein configured to receive a portion of the fuel actuation lever to minimize lateral movement of the bracket relative to the nozzle handle;

a plurality of retaining members being attached to said bracket and extending outwardly therefrom, said retaining members being configured to prevent lateral removal of said bracket when bracket is disposed between the fuel actuation lever and the guard, said bracket having four corners, each of said corners having one of said retaining members attached thereto, said retaining members having a perimeter edge having an annular shape, each of said retaining members lying in a plane orientated parallel with a plane of said bracket;

a compartment being disposed between said front wall and said rear wall, a plurality of wipes being positioned within said compartment, said front wall having an aperture therein to access an interior of said compartment;

a door being attached to said bracket and being selectively positioned in a closed position to close said aperture, said door being positioned in an open position to access said compartment, said door being hingedly coupled to said bracket, a handle being attached to said door; and a fastener being attached to said bracket, said bracket being securable to a vehicle with said fastener, said fastener including a first mating member and a second mating member, said first mating member being attached to said bracket, said second mating member being attachable to the vehicle, said fastener comprising a hook and loop fastener.

9. A method of fueling a vehicle, said method including the steps of:

extending a fuel nozzle into a vehicle, a nozzle handle being attached to said nozzle, a fuel actuation lever being attached to said nozzle and guard being attached to said nozzle handle and extending around said fuel actuation lever;

providing a bracket;

positioning said rectangular bracket in abutment with the fuel actuation lever and the guard to support the fuel actuation lever in an engaged position, said bracket having a front wall and a rear wall, said bracket having a first end and a second end disposed opposite of each other and a pair of lateral sides, said first end being contactable with the fuel actuation lever and said second end being contactable with the guard to retain the fuel actuation lever in a spaced relationship with said guard, a plurality of retaining members being attached to said bracket and extending outwardly therefrom, said retaining members being configured to prevent lateral removal of said bracket when bracket is disposed between the fuel actuation lever and the guard, said bracket having four corners, each of said corners having one of said retaining members attached thereto; and wherein the step of providing said bracket further includes the step of a compartment being disposed between said front wall and said rear wall, a plurality of wipes being positionable within said compartment, said front wall having an aperture therein to access an interior of said compartment, a door being attached to said bracket and being selectively positioned in a closed position to close said aperture, said door being positioned in an open position to access said compartment.

10. The method according to claim 9, wherein the step of providing said bracket further includes the step of said retaining members each having a perimeter edge having an annular shape, each of said retaining members lying in a plane orientated parallel with a plane of said bracket.

11. The method according to claim 9, wherein the step of providing said bracket further includes the step of said first end having a notch therein configured to receive a portion of the fuel actuation lever to minimize lateral movement of the bracket relative to the nozzle handle.

12. The method according to claim 9, further including the step of attaching said bracket to the vehicle with a fastener after the vehicle has been filled with fuel, said fastener being attached to said bracket, said bracket being securable to a vehicle with said fastener, said fastener including a first mating member and a second mating member, said first mating member being attached to said bracket, said second mating member being attachable to the vehicle.

* * * * *